US005791095A

United States Patent [19]

Sorkin

[11] Patent Number: 5,791,095

[45] **Date of Patent: *Aug. 11, 1998**

[54] CHAIR FOR USE IN CONSTRUCTION

[76] Inventor: Felix L. Sorkin, 4115B Greenbriar Dr., Stafford, Tex. 77477

[ * ] Notice: The term of this patent shall not extend beyond the expiration date of Pat. No. 5,555,693.

[21] Appl. No.: 666,651

[22] Filed: Jun. 18, 1996

Related U.S. Application Data

[63] Continuation-in-part of Ser. No. 372,053, Jan. 12, 1995, Pat. No. 5,555,693.

[51] Int. Cl.[6] ..... E04C 5/20

[52] U.S. Cl. ..... 52/105; 52/679; 52/689; 404/135

[58] Field of Search ..... 52/677, 679, 680, 52/681, 682, 683, 684, 685, 686, 687, 688, 689, 678, 700, 105; 404/134, 135, 136; 8/354, 380

[56] References Cited

U.S. PATENT DOCUMENTS

| | | | |
|---|---|---|---|
| D. 334,133 | 3/1993 | Hartzheim | D8/354 |
| 4,000,591 | 1/1977 | Courtois | 52/689 |
| 4,483,119 | 11/1984 | Hernandez | 52/689 |
| 4,682,461 | 7/1987 | Sizemore | 52/689 |
| 4,756,641 | 7/1988 | Hartzheim | 52/689 |

FOREIGN PATENT DOCUMENTS

| | | | |
|---|---|---|---|
| 227969 | 5/1960 | Australia | 52/689 |
| 575043 | 1/1946 | United Kingdom | 52/678 |

OTHER PUBLICATIONS

Meadow Steel Products Price List:1994; pp. 1–7.

*Primary Examiner*—Michael Safavi

[57] ABSTRACT

A chair having a receiving area with a horizontal section and a generally parabolic section extending transverse to the horizontal section, and a plurality of separate legs extending downwardly from the receiving area. Each of the legs has a foot extending horizontally outwardly therefrom. The receiving area and the plurality of legs are integrally formed together of a polymeric material. The horizontal section and the generally parabolic section have a cruciform configuration. Each of the legs has a rectangular cross-section in a horizontal plane. The horizontal section of the receiving area has a numerical indicia molded thereon which is indicative of a distance between a top of the horizontal section and a bottom of the foot. The foot of one of the plurality of separate legs has a top surface with a numerical indicia molded thereon. The numerical indicia on the horizontal section of the receiving area is oriented in a different direction than the numerical indicia on the foot.

17 Claims, 2 Drawing Sheets

CHAIR FOR USE IN CONSTRUCTION

RELATED APPLICATIONS

The present application is a continuation-in-part of U.S. patent application Ser. No. 08/372,053, filed on Jan. 12, 1995, and entitled "CHAIR FOR USE IN CONSTRUCTION", now U.S. Pat. No. 5,555,693.

TECHNICAL FIELD

The present invention relates generally to chairs and spacers that are used in construction activities for the support of post-tension cables, rebars, or mesh. More particularly, the present invention relates to chairs of plastic construction that are used for the support of such materials in poured decks and precast work.

BACKGROUND ART

Chairs are commonly used in the construction industry for the support of post-tension cables, rebars, and mesh above a surface. Typically, when such materials are used, they must be supported above the surface when the concrete is poured. Chairs are used with poured decks, precast work, and slab-on-grade applications. In normal use, a receiving area formed on the chair will contact and support the rebar while the base of the chair rests on a deck or on a grade. When the concrete is poured, the chair will support the post-tension cable or rebar a proper distance above the bottom surface.

In deck applications, the most common chair that is employed is a metal chair manufactured by Meadow Steel Products of Tampa, Florida. This chair is made from a pair of bent wires. A first bent wire has a receiving area for the receipt of the rebar. The receiving area is bent into the wire so as to form a generally parabolic indentation. The ends of the wire are bent at a ninety degree angle so as to support the wire in an upright condition above the deck. A second wire is formed in an inverted U-shaped configuration and is welded to the bottom edge of the receiving area of the first wire. The second wire also has ends that are bent at generally ninety degree angles. The first wire will extend in a plane transverse to the second wire such that the first and second wire form the "legs" of the chair. The ends of each of these wires will rest on the deck while the table is supported. After the concrete has solidified, and the deck is removed, the bottom surfaces of the ends of the wire will be exposed. As such, it is necessary to coat the ends of the wires with an anti-rust material. The rebar can be tied to the receiving area.

In normal applications, this Meadow Steel Products' chair will support a single rebar above the deck for a desired distance. However, in other applications, it is often desirable to place a second smaller chair beneath the larger chair so that another additional rebar can be extended so as to intersect with the first rebar. The chairs come in a large number of sizes and heights. In some circumstances, it is often desirable to place more than one rebar into the receiving area of the chair. To accommodate this problem the receiving area of the chair has a generally parabolic indentation.

Corrosion and cost are major problems affecting the Meadow Steel Products' chair. In order to form such a chair, a great deal of manufacturing must take place, including metal forming, bending, dipping, and welding. These activities, along with the cost of the material used to form the chair, make the cost of the chair relatively expensive. If the Meadow steel chair is not coated, then corrosion can adversely affect the product. Such corrosion can occur even in coated metal chains.

In the past, many attempts have been made to create chairs of plastic material that can serve the purposes of the Meadow Steel Products' chair. In general, such efforts have resulted in plastic chairs that are ineffective, cumbersome to use, or unable to withstand the forces imparted by the cable upon the chair. In some cases, support rings and other structures have been placed upon the plastic chairs so as to give the chair sufficient strength. Unfortunately, as such structures are added to the plastic chair, it becomes increasingly difficult to tie the rebar to the receiving area of the chair. This often requires a threading of the wire through the interior of the plastic chair in order to tie the rebar. As a result of this complicated procedure, many construction workers have been unwilling to use such plastic chairs. Additionally, the interior structures and support rings of such plastic chairs eliminate the ability to extend the rebars in an intersected relationship since one chair cannot be stacked upon or over another.

The plastic chairs of the past have often broken, collapsed, or tipped over in actual use. In the case of the plastic chairs, the base of the chair has only a small area of contact with the deck. Even with the necessary internal structure, experience has shown that such plastic chairs fail to withstand the weight of the rebar.

One particular type of plastic chair that has had some success is manufactured by Aztec Concrete Accessories, Inc. of Fontana, Calif. This chair has a plurality of legs that extend downwardly from a central receiving area. The central receiving area has a generally semi-circular configuration that can receive only a single rebar. An annular ring extends around the legs of the chair so as to provide the necessary structural support for the chair. The feet of the chair extend inwardly of the ring. In use, these chairs have had a tendency to tip over. Additionally, these chairs fail to accommodate the need to align rebars in an intersected relationship. The use of the annular ring extending around the legs of the chairs requires that a wire must be threaded through the interior of the chair in order to tie the rebar within the receiving area. As such, these chairs have been generally ineffective for meeting the needs of the construction industry. In the past, these and other plastic chairs have been unable to withstand the loads placed upon them. As such, breakage and insufficient rebar support has resulted.

In the past, various U.S. and foreign patents have issued on various devices relating to chairs. For example, U.S. Pat. No. 4,000,591, issued on Jan. 4, 1977, to P. D. Courtois describes a holder adapted for supporting an anchor insert to be embedded into a concrete slab. The holder includes an enclosure, a plurality of legs extending from the enclosure, and a foot at the outer end of each leg and adapted with the remaining feet to support the enclosure in a spaced relationship above the floor of a concrete form. The enclosure includes a seat adapted for supporting an insert with the foot of the insert seated thereon. This holder device is not designed for the support of rebars in the concrete. British Patent No. 575,043, issued on Jan. 31, 1946, to K. Mattson, teaches a chair-like device that is intended for use in supporting a tendon above the floor of a slab. The support includes a clip formed at the receiving area so as to snap onto the exterior surface of a tendon. Various circular openings are formed in the body of this chair so as to allow tendons to be extended therethrough in parallel and transverse relationship. Australian Patent No. 227,969, published on Nov. 19, 1959, to Keith Douglas Moris describes a reinforcing chair which includes a plurality of legs extending downwardly from a cruciform receiving area. The legs do not have feet at the bottom and the receiving area does not have a flat horizontal section.

Various experiments and studies have been carried out with the form of the present invention as described in U.S. patent application Ser. No. 08/372,053, from which this application continues. Since the chairs come in a wide variety of sizes ranging from three-quarters inch to over eighteen inches, it is often common for the construction worker to accidentally place chairs of various sizes on the slab. Additionally, workmen often have the problem of orienting the chair in an incorrect direction prior to laying the rebar on the receiving area of the chair. As such, it was found important to provide positive indicia to the workmen so as to allow the workmen to determine the proper orientation of the chair and also to assure that the proper size of the chair is used continuously along a single strand of rebar. Prior art metallic chairs have not been able to provide permanent numerical indicia on the surface of the chair. As a result, with prior art metallic chairs, the chairs of various sizes would often be intermixed along the construction slab.

The typical metallic chairs are formed of wires having a circular cross-section. The circular cross-section construction of the wires used for typical metallic chairs have an inherent flaw. The very nature of the circular cross-section of the wires reduces the structural integrity and strength of the chair construction. Ultimately, it would be preferable if the legs of the chair had a rectangular cross-section for added structural integrity and strength.

The typical method of forming metallic chairs requires the welding of a lower wire to the bottom of an upper wire. A concave area is formed in the top surface of the upper wire so as to provide support for the rebar passing thereover. The lower wire provides no direct support for the underside of the rebar. As a result, all of the downward force of the rebar is applied directly onto the top surface of the upper wire. There is no distributed load of the rebar over the upper surface of the lower wire.

It is an object of the present invention to provide a chair that is corrosion-proof and relatively inexpensive.

It is another object of the present invention to provide a chair that facilitates the ability to stack the chairs.

It is a further object of the present invention to provide a chair that withstands the forces imparted on it.

It is a further object of the present invention to provide a chair that is easy to manufacture and easy to use.

It is still another object of the present invention to provide a chair that has a receiving area that can accommodate several rebars.

It is a further object of the present invention to provide a chair which provides permanent numerical indicia as to the size of the chair.

It is still a further object of the present invention to provide a chair that provides indicia facilitating the proper orientation of the chair relative to the rebar.

It is another object of the present invention to provide a chair which distributes the downward force of the weight of the rebar over a larger surface area.

These and other objects and advantages of the present invention will become apparent from a reading of the attached specification and appended claims.

SUMMARY OF THE INVENTION

The present invention is a chair that comprises a receiving area having a horizontal section, a generally parabolic section extending transverse to the horizontal section, and a plurality of separate legs extending downwardly from the receiving area. Each of the legs has a foot extending horizontally outwardly therefrom. A foot of one of the plurality of legs is separated from the foot of an adjacent leg. The receiving area and the plurality of legs are integrally formed together of a polymeric material.

One of the plurality of separate legs extends downwardly from one end of the horizontal section while another of the plurality of separate legs extends downwardly from an opposite end of the horizontal section. One of the plurality of separate legs also extends downwardly from one end of the parabolic section while another of the plurality of legs extends downwardly from an opposite end of the generally parabolic section.

The receiving area has numerical indicia molded thereon. This numerical indicia is indicative of a distance of a top of the horizontal section from a bottom of the foot. The numerical indicia are formed on the horizontal section of the receiving area. The foot of one of the plurality of separate legs has a top surface with numerical indicia molded thereon. The numerical indicia on the foot is identical in value to the numerical indicia on the receiving area. The numerical indicia on the receiving area is oriented in a different direction then the numerical indicia on the foot.

In the present invention, the legs extend downwardly from the horizontal section in a plane transverse to the legs extending downwardly from the generally parabolic section. Each of the plurality of separate legs has a rectangular cross-section. Each of the feet of the plurality of separate legs has a planar horizontal top surface. The receiving area has a cruciform configuration.

DETAILED DESCRIPTION OF THE INVENTION

Figure 1:
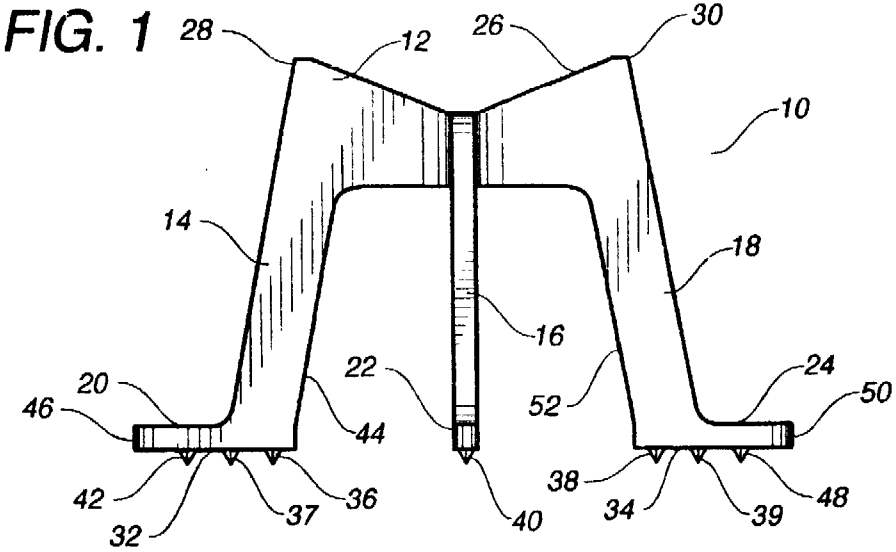
FIG. 1 is a side elevational view of the chair in accordance with the preferred embodiment of the present invention.

Referring to FIG. 1, there is shown at 10 the chair in accordance with the preferred embodiment of the present invention. The chair 10 includes a receiving area 12, and a plurality of legs 14, 16, and 18. It can be seen that the legs 14, 16, and 18 extend downwardly from the receiving area 12. Leg 14 has a foot 20 extending outwardly horizontally therefrom. Leg 16 also has a foot 22 extending horizontally outwardly therefrom. Leg 18 has a foot 24 extending horizontally outwardly therefrom. In the preferred embodiment of the present invention, the receiving area 12, the legs 14, 16 and 18, and the feet 20, 22 and 24 are integrally formed together of a polymeric material. The legs are separate from each other below the receiving area 12. Each of the legs 14, 16 and 18 has a rectangular cross-section in a horizontal plane.

The receiving area 12 has a top surface defining a generally parabolic indentation 26. Indentation 26 is suitable for the receipt of a post-tension cable or a rebar therein. If it is necessary to string additional, rebars in a side-by-side relationship to the rebar in the bottom portion of the indentation 26, then the upper portions of the indentation 26 can accommodate such rebars thereon.

It can be seen that the first leg 14 extends downwardly from the upper end 28 of the receiving area 12. Similarly, leg 18 also extends downwardly from the opposite upper end 30 of receiving area 12. Leg 16 extends downwardly from the lower central portion of the receiving area 12.

In FIG. 1, it can be seen that the legs 14 and 18 extend outwardly slightly angled (approximately ten degrees) from the vertical. The angling of legs 14 and 18 provides proper structural support for the receiving area 12.

Although the indentation 26 of the receiving area 12 is identified as a generally "parabolic" indentation, it is possible that, within the scope of the present invention, the sides of the indentation 26 can be straight so as to taper downwardly to the center bottom of the receiving area 12. In such an arrangement, the taper would generally extend at approximately twenty degrees to the horizontal.

It can be seen that the foot 20 has a generally planar bottom surface 32 and a horizontal planar top surface 33. The foot 24 also has a planar bottom surface 34 and a horizontal planar top surface 35. The planar bottom surfaces 32 and 34 have a horizontal orientation. A projection 36 extends downwardly from the bottom surface 32 of the foot 20. A projection 38 extends downwardly from the bottom surface 34 of the foot 20. Similarly, a projection 40 extends downwardly from the bottom surface of the foot 22. A second projection 42 also extends downwardly from the bottom surface 32 of the foot 20. The first projection 36 is positioned adjacent an inner edge 44 of the foot 20 while the second projection 42 is positioned adjacent an outer edge 46 of the foot 20. Similarly, the second foot 24 has a second projection 48 adjacent the outer edge 50 of the foot 24. The first projection 38 is positioned the inner edge 52 of the foot 24. An additional middle projection 37 is formed on planar bottom surface 32 between projections 36 and 42. Similarly, a projection 39 is formed on the planar bottom surface 34 between projections 38 and 48. Each of the projections 36, 37, 38, 39, 42 and 48 have an inverted pyramidal configuration. These projections are integrally formed with the feet 20 and 24. The projections have a point at the bottom of sufficient sharpness so as to bite into a surface supporting the chair 10 when the chair 10 is under a load.

Importantly, the configuration of the projections 36, 37, 38, 39, 42 and 48 enhances the structural stability and strength of the chair 10 of the present invention. Whenever a load is applied to the receiving area 12 of the chair 10, then this load will cause the projections to bite, to engage or to become embedded in the deck under which the chair 10 is placed. As such, the projections will facilitate the ability of the legs 14 and 18 to resist deformation under the presence of a load. As a result, it is possible to create the chair 10 without having an internal structural ring or other structural members. The horizontally outwardly extending feet 20 and 24, in combination with the projections 36, 37, 38, 39, 42 and 48, enhance the stability of the chair 10 on the flat surface upon which it is placed. The projections help to support the vertical loads without horizontal deflections in the chair 10.

Figure 2:
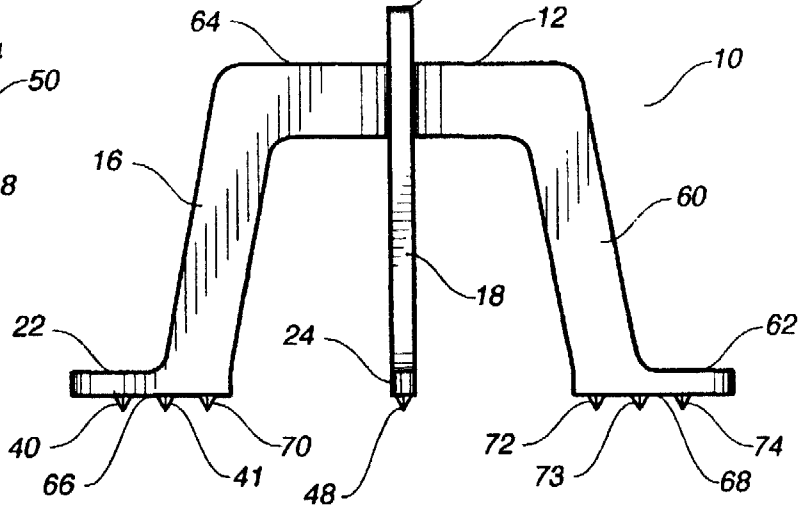
FIG. 2 is a front view of the chair of the present invention.

FIG. 2 shows an end view of the chair 10 of the present invention. It can be seen that the second pair of legs 16 and 60 extend downwardly from the ends of the horizontal section 64 of the receiving area 12. The legs 16 and 60 extend outwardly in a single plane transverse to the legs 14 and 18. Legs 16 and 60 are angled outwardly (in approximately twelve degrees to the vertical). Foot 22 extends horizontally outwardly from the leg 16. Foot 62 extending horizontally outwardly from the leg 60. In normal use, the horizontal section 64 of the legs 16 and 60 will be aligned with the cable extending within the receiving area 12. As such, this horizontal section 64 distributes the forces imparted by the rebar onto the chair 10 over a larger surface area. Each of the legs 16 and 60 has a generally rectangular cross-section in the horizontal plane.

The feet 22 and 62 have flat planar bottom surfaces 66 and 68, respectively. The feet 22 and 62 also have horizontal planar top surfaces 67 and 69, respectively. Projections 40, 41 and 70 extend downwardly from the flat bottom surface 66 of foot 22. Projections 72, 73 and 74 extend downwardly from the flat planar surface 68 of the foot 62. The projections 40, 41, 70, 71, 72, and 74 have a configuration similar to that identified in FIG. 1. These projections also bite into the supporting surface so as to resist deflecting forces and serve to provide structural strength and integrity in the manner previously described in connection with FIG. 1.

Figure 3:
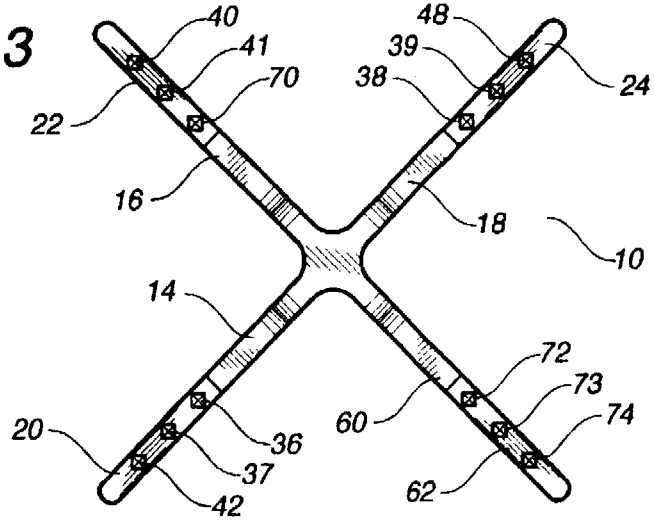
FIG. 3 is a bottom view of the chair of the present invention.

FIG. 3 shows a bottom view of the chair 10. Particularly, in FIG. 3, it can be seen that the legs 14 and 18 are coplanar. Similarly, legs 16 and 60 are coplanar in a plane transverse to that of legs 14 and 18. In the present invention, the legs, the feet and the projections are integrally formed together of a polymeric material. In the preferred embodiment of the present invention, the maximum amount of structural integrity and strength is obtained through the use of a glass-filled nylon material. It can be seen that the feet 20, 22, 24, and 62 extend horizontally outwardly from the legs. The use of such feet gives stability and spreads the forces imparted by the cable upon the receiving area over a larger area of the deck onto which such feet are placed.

Importantly, in the present invention, the feet 20, 22, 24, and 62 are configured so as to have a relatively narrow and short configuration. Also, each of the feet 20, 22, 24 and 62 have horizontal planar top surfaces 33, 35, 67 and 69, respectively. The width of the feet generally matches the thickness of the legs. As a result of the size and the top surface, it becomes possible to staple the feet to the deck upon which such feet are placed. The stapling of the feet to the deck assures that a deformation of the plastic chair 10 will not occur. Additionally, such stapling assures that the chair will not tip over, become dislodged, or moved from its desired location. The prior art configurations of plastic chairs have failed to provide for the stability of the feet of the chair.

Figure 4:
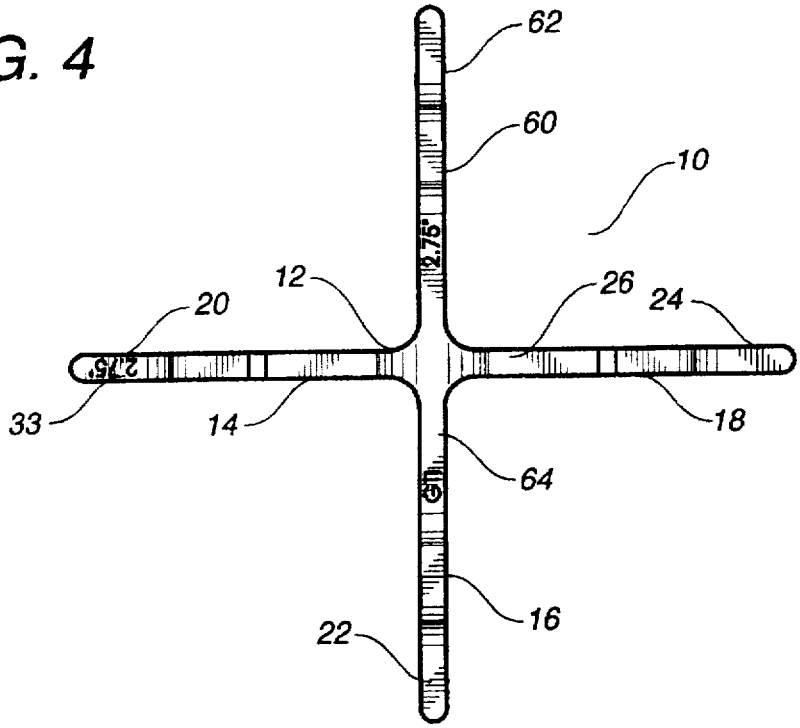
FIG. 4 is a plan view of the chair of the present invention.

Referring to FIG. 4, there is shown a top view of the chair 10 of the present invention. Importantly, the configuration of the present invention, as illustrated in FIG. 4, shows the inclusion of numerical indicia on the horizontal section 64 of the receiving area 12 and also on the top surface 33 of the foot 20. It can also be seen that the generally parabolic section 26 of the receiving area 12 extends in transverse relationship to the horizontal section 64 of the receiving area 12. The arrangement of the horizontal section 64 with respect to the parabolic section 26 has a cruciform configuration.

As can be seen in FIG. 4, the numeric reference "2.75" is molded onto the horizontal section 64 of the receiving area 12. This numerical indicia "2.75" is indicative of the receiving height of the chair 10. In other words, the numerical indicia "2.75" is the distance between the bottom surface of the feet and the top surface of the horizontal section 64 of the chair 10. Additionally, another indicia identified with the letters "GTI" is molded onto the top surface of the horizontal section 64. The alphanumeric reference "GTI" is indicative of the source of origin of the chair 10. The use of the numeric indicia "2.75" on the horizontal section 64 of the receiving area 12 allows the workmen at the construction site to have visual evidence that all of the chairs which are used on the slab are of identical heights. As a result, the use of such a numerical indicia assures that workmen will not accidentally place a three inch chair among the 2.75 inch chairs. Additionally, the indication of the source of origin of the chair 10 assures that the workmen will not accidentally mix the chairs from one manufacturer with the chairs from another manufacturer. The present invention avoids inconsistencies in the arrangement of chairs. If there is a difficulty or a problem with any of the chairs provided at the construction site, then the manufacturer of the chair can be easily identified from the use of the indicia "GTT" on the horizontal section 64 of the receiving area 12.

It is important to note that another numerical indicia "2.75" is also imprinted on the top surface 33 of the foot 20. It can be seen that the numerical indicia on the foot 20 is at a different orientation than the numerical indicia "2.75" on the horizontal section 64. In particular, the numerals which make up the numerical indicia "2.75" on the foot 20 are oriented ninety degrees relative to the numerical indicia on the horizontal section 64. As a result, the workmen at the construction site can determine the height of each of the chairs used for the support of the rebar from various angles. The use of the numerical indicia on the top surface 33 of the foot 20 allows the size of the chair to be inspected even after installation of the rebar. The inclusion of the numerical indicia on the horizontal section 64 and on the top surface 33 of the foot 20 improves quality control in the installation of the chairs 10 at the construction site.

Figure 5:
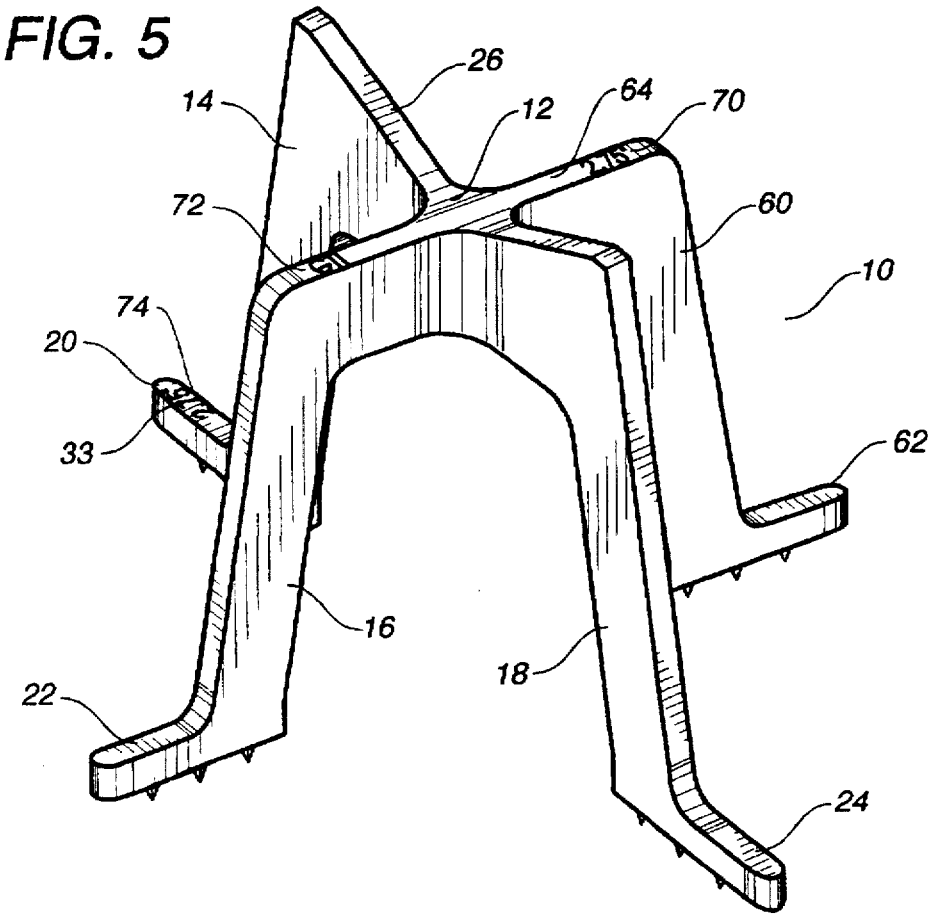
FIG. 5 is a perspective view of the chair of the present invention.

FIG. 5 shows a perspective view of the chair 10. As can be seen, the chair 10 has legs 14 and 18 extending downwardly from the ends of the generally parabolic section 26 of the receiving area 12. Legs 16 and 60 extend downwardly from opposite ends of the horizontal section 64 of the receiving area 12. The numerical indicia 70 appears clearly on the top surface of the horizontal section 64. Also, the alphanumeric indicia 72 also appears clearly on the top surface of the horizontal section 64. The use of such indicia assures that accidental mixups of various sizes of construction chairs 10 will not occur. Additional orientation information is provided by the use of the numerical indicia 74 on the top surface 33 of the foot 20. After repeated use of the chair 10, the workmen will find that it is relatively easy to orient each of the chairs 10 in the proper direction along a length of rebar.

It can also be seen in FIG. 5 that each of the legs 14, 16, 18 and 60 have a generally rectangular cross-section. The use of such a rectangular cross-section enhances the ability to manufacturer the chair 10 of the present invention through an injection molding process. The rectangular cross-section of each of the legs of the chair 10 also enhances the structural integrity and strength of the legs. Experiments have shown that the relatively wide surfaces of the legs 14, 16, 18 and 60 strongly resist deformations in the planes upon which force is imparted. As can be seen, legs 14 and 18 are relatively wide in the plane transverse to the horizontal section 64 and relatively narrow in the plane parallel to the horizontal section 64. Also it can be seen that the legs 16 and 60 are relatively wide in the planes parallel to the horizontal section 64 but narrow in the planes transverse to the horizontal section 64. This configuration assures a strong chair which is resistive of deformation. The use of the horizontal section 64 which will extend in surface-to-surface contact with the underside of a rebar extending through the receiving area 12 assures that the forces of the rebar are distributed over a relatively large surface area.

It is also important to note that the chair 10 of the present invention enhances quality control in the installation of the rebar into the receiving area 12. Even after the rebar is installed in the receiving area, the size of the chair 10 can be determined by an inspection of the indicia 74 on the top surface 33 of the foot 20. A proper visual inspection of the chair sizes can be carried out, in this manner, even though the rebar would cover the numerical indicia 70 on the horizontal section 64. As a result, the present invention allows for the workmen to inspect the size of the chair 10 before and after the installation of the rebar onto the chair 10.

The configuration of the embodiment of FIGS. 1–5 greatly facilitates the installation and use of such chairs at the construction site. Since there are no interior structures on the chair, it is a relatively easy process to tie the rebar within the receiving area 12. The present invention eliminates the need to thread a wire through a complex interior structure. Since the present invention is manufactured through an injection molding process, each of the plastic chairs 10 is relatively inexpensive and corrosion-proof in comparison with conventional metal chairs. The use of plastic chairs eliminates the problems of corrosion or discoloring that can occur through the use of metal chairs. The absence of the interior support structure means that smaller chairs can be positioned on the interior of a larger chair so that the rebars can be aligned in parallel planar relationship or positioned in intersecting relationship.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A chair comprising:

a receiving area having a horizontal section and a generally parabolic section in a plane extending transverse to a plane of said horizontal section, said generally parabolic section having a portion of a top surface thereof in coplanar relationship with a top surface of said horizontal section; and a plurality of separate legs extending downwardly from said receiving area, a pair of said plurality of separate legs extending downwardly from opposite ends of said horizontal section, another pair of said plurality of separate legs extending downwardly from opposite ends of said parabolic section, each of said plurality of legs having a foot extending horizontally outwardly therefrom, a foot of one of said plurality of legs being separate from a foot of an adjacent leg, said receiving area and said plurality of legs and the foot associated with each of said plurality of legs being integrally formed together of a polymeric material.

2. The chair of claim 1, said receiving area having a numerical indicia molded thereon, said numerical indicia being indicative of a distance of a top of said horizontal section from a bottom of said foot.

3. The chair of claim 2, said numerical indicia being formed on said horizontal section.

4. The chair of claim 2, the foot of one of said plurality of separate legs having a top surface with a numerical indicia molded thereon, said numerical indicia on the foot having an identical value as said numerical indicia on said receiving area.

5. The chair of claim 4, said numerical indicia on said receiving area being oriented in a direction, said numerical indicia on the foot being oriented in a different direction than said numerical indicia on said receiving area.

6. The chair of claim 1, said legs extending downwardly from said horizontal section extending in a plane transverse to said legs extending downwardly from said generally parabolic section.

7. The chair of claim 1, each of said plurality of separate legs having a rectangular cross-section.

8. The chair of claim 1, each foot of said plurality of separate legs having a planar horizontal top surface.

9. The chair of claim 8, said top surface of one of the feet of said plurality of separate legs having a numerical indicia formed thereon, said numerical indicia being indicative of a distance between a bottom of the foot and a top of said horizontal section.

10. The chair of claim 1, said receiving area having a cruciform configuration.

11. A chair comprising:

a receiving area having a horizontal section and a generally parabolic section in a plane transverse to a plane of said horizontal section; and a plurality of separate legs extending downwardly from said receiving area, each of said legs having a foot integrally formed therewith and extending horizontally outwardly therefrom, said receiving area and said plurality of legs being integrally formed together of a polymeric material, each of said plurality of separate legs having a rectangular cross-section in a horizontal plane, said foot of at least one of said plurality of separate legs having a top surface with a numerical indicia formed thereon, said numerical indicia being representative of a distance between a bottom of the foot and a surface of said receiving area.

12. The chair of claim 11, said receiving area having a numerical indicia molded thereon, said numerical indicia on said receiving area being representative of the distance between a bottom of the foot and the surface of said receiving area.

13. A chair comprising:

a receiving area;

a plurality of legs extending downwardly from said receiving area, each of said legs having a foot extending horizontally outwardly therefrom, said receiving area and said plurality of legs being integrally formed together of a polymeric material; and a numerical indicia molded on at least one of said receiving area and said plurality of separate legs, said numerical indicia being indicative of a distance between a bottom of the foot and a surface of said receiving area.

14. The chair of claim 13, said receiving area having a horizontal section extending transverse to a generally parabolic section, said receiving area 10 having a cruciform configuration.

15. The chair of claim 14, said numerical indicia being molded onto said horizontal section.

16. The chair of claim 13, each of the feet of said plurality of legs having a planar horizontal top surface, said numerical indicia being molded onto said top surface of at least one of the feet of said plurality of legs.

17. The chair of claim 16, said receiving area having a horizontal section extending transverse to a generally parabolic section, said numerical indicia being molded onto said horizontal section, said numerical indicia on said horizontal section having an orientation different than an orientation of said numerical indicia on the foot.

* * * * *